US010984690B2

(12) United States Patent
Shangguan

(10) Patent No.: US 10,984,690 B2
(45) Date of Patent: Apr. 20, 2021

(54) PROTECTION CIRCUIT FOR GATE DRIVER ON ARRAY UNIT, AND ARRAY SUBSTRATE

(71) Applicant: BOE TECHNOLOGY GROUP CO., LTD., Beijing (CN)

(72) Inventor: Xingchen Shangguan, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 414 days.

(21) Appl. No.: 15/515,017

(22) PCT Filed: Mar. 2, 2016

(86) PCT No.: PCT/CN2016/075339
§ 371 (c)(1),
(2) Date: Mar. 28, 2017

(87) PCT Pub. No.: WO2017/041457
PCT Pub. Date: Mar. 16, 2017

(65) Prior Publication Data

US 2017/0221401 A1 Aug. 3, 2017

(30) Foreign Application Priority Data

Sep. 8, 2015 (CN) ..... 201520692483.6

(51) Int. Cl.
*G09G 3/00* (2006.01)
*G09G 3/36* (2006.01)

(52) U.S. Cl.
CPC ..... *G09G 3/006* (2013.01); *G09G 3/3677* (2013.01); *G09G 2310/0289* (2013.01); *G09G 2330/04* (2013.01); *G09G 2330/06* (2013.01)

(58) Field of Classification Search
USPC ..... 345/212
See application file for complete search history.

(56) References Cited

U.S. PATENT DOCUMENTS 5,956,219 A 9/1999 Maloney
2006/0017672 A1 1/2006 Aoki
(Continued)

FOREIGN PATENT DOCUMENTS

CN 103106880 A 5/2013
CN 103295530 A 9/2013
CN 204946515 U 1/2016

OTHER PUBLICATIONS

Search Report and Written Opinion dated Jun. 13, 2016 from State Intellectual Property Office of the P.R. China.
(Continued)

*Primary Examiner* — Amr A Awad
*Assistant Examiner* — Jonathan G Cooper
(74) *Attorney, Agent, or Firm* — Dilworth & Barrese.com; Michael J. Musella, Esq.

(57) ABSTRACT

A protection circuit for a gate driver on array (GOA) unit, which relates to ESD or EOS protection for the gate GOA unit. The protection circuit includes: a first voltage gating module configured to output, when a gate line signal output end should output a valid driving voltage of a gate driving signal, an output voltage of an output end of a first voltage source; and a first protection module, an input end of which is connected to an output end of the first voltage gating module, and an output end of which is connected to a gate line; wherein in the case where the output voltage of the first voltage source and a current output voltage of the gate line signal output end satisfies a first predetermined condition, the first protection module outputs the output voltage of the output end of the first voltage source as an adjusted gate driving signal.

20 Claims, 7 Drawing Sheets

(56) References Cited

U.S. PATENT DOCUMENTS

| | | | | |
|---|---|---|---|---|
| 2008/0174577 | A1* | 7/2008 | Fujita | G09G 3/3677 345/204 |
| 2014/0111413 | A1* | 4/2014 | Chen | G11C 19/28 345/100 |
| 2016/0148922 | A1* | 5/2016 | Kim | H01L 27/0255 361/56 |

OTHER PUBLICATIONS

Partial Supplemental European Search Report issued by the European Patent Office in corresponding European Patent Application No. 16843397.7 dated Feb. 7, 2019.

Neil T. Hardwick, Controlling ESD via Polymer Technology, Advanced Packaging, IHS Publishing Group, US, vol. 7, No. 7, Sep. 1, 1998, pp. 28, 30, 32.

* cited by examiner

PROTECTION CIRCUIT FOR GATE DRIVER ON ARRAY UNIT, AND ARRAY SUBSTRATE

TECHNICAL FIELD

The present disclosure relates to an ESD or EOS protection of a gate driver on array (GOA) unit, and more particularly relates to a protection circuit of a GOA unit and an array substrate.

BACKGROUND

Electrical Static Discharge (ESD) is a top killer of existing electronic devices. In a field of display, for the reasons that a display screen of a thin film transistor liquid crystal display (TFT-LCD), for example, has a large area and that an electronic device including TFT-LCD is directly contacted with human bodies and so on, it is easy for TFT-LCD to be influenced by ESD, thereby resulting in display abnormality. Additionally, TFT-LCD is easily influenced by Electrical Over Stress (EOS).

In the field of display, the gate driver on array (GOA) unit is usually integrated at outside of a display panel, and is easier to be influenced by ESD or EOS. Especially, in various ultra-thin (Air) electronic devices, it is easier to cause the GOA unit to be broken down, thereby resulting in the display abnormality of the display panel.

Therefore, it needs to perform ESD or EOS protection for the GOA unit, so as to enhance reliability of the display panel and raise the quality of the electronic devices.

SUMMARY

In order to solve the above technical problem, there is provided in the present disclosure a protection circuit of a gate driver on array (GOA) unit, which is connected to a gate line signal output terminal of the GOA unit, wherein the protection circuit comprises: a first voltage gating module, whose input terminal is connected to an output terminal of a first voltage source, configured to output an output voltage of an output terminal of the first voltage source at an output terminal of the first voltage gating module when the gate line signal output terminal should output a valid driving voltage of a gate driving signal; a first protection module, whose input terminal is connected to the output terminal of the first voltage gating module, and output terminal is connected to a gate line; wherein the first protection module outputs the output voltage of the output terminal of the first voltage source as an adjusted gate driving signal in the case that the output voltage of the output terminal of the first voltage source and a current output voltage of the gate line signal output terminal satisfies a first predetermined condition.

According to an embodiment of the present disclosure, the protection circuit further comprises: a second voltage gating module, whose input terminal is connected to an output terminal of a second voltage source, configured to output an output voltage of an output terminal of the second voltage source at an output terminal of the second voltage gating module when the gate line signal output terminal should output an inactive driving voltage of a gate driving signal; a second protection module, whose input terminal is connected to the output terminal of the second voltage gating module, and output terminal is connected to the gate line; wherein the second protection module outputs the output voltage of the output terminal of the second voltage source as an adjusted gate driving signal in the case that the output voltage of the output terminal of the second voltage source and the current output voltage of the gate line signal output terminal satisfies a second predetermined condition.

There is further provided in an embodiment of the present disclosure an array substrate, comprising a protection circuit of the gate driver on array GOA unit as described above.

Other characteristics and advantages of the present disclosure will be described in the subsequent specification, and a part of them are obvious from the specification, or are known through implementation of the present disclosure. Purposes and other advantages of the present disclosure can be implemented and obtained through structures specifically pointed out in the specification, Claims and figures.

BRIEF DESCRIPTION OF THE DRAWINGS

Embodiments of the present disclosure will be described in detail by combining with figures. The above and other purposes, characteristics and advantages of the present disclosure would become more evident. Figures are used to provide further understanding of the embodiments of the present disclosure, and constitute a part of the specification, are used to explain the present disclosure together with the embodiments of the present disclosure, and do not form a limitation to the present disclosure. In the figures, same reference marks generally represent same means or steps.

DETAILED DESCRIPTION

Figure 1:
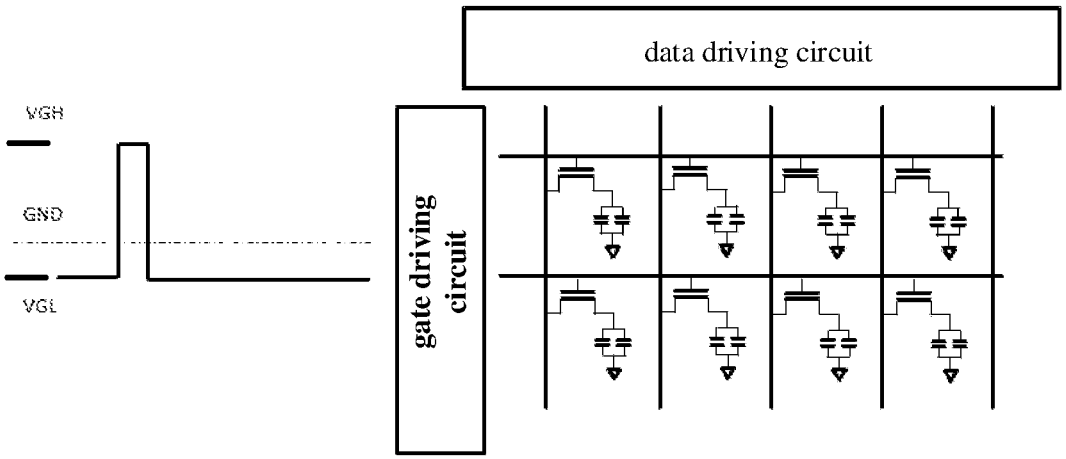
FIG. 1 is a schematic diagram of a GOA unit and its gate driving signal according to an embodiment of the present disclosure.

In order to make purposes, technical solutions and advantages of embodiments of the present disclosure more evident, exemplary embodiments of the present disclosure will be described below in detail by referring to figures. Obviously, the exemplary embodiments described below are just a part of embodiments of the present disclosure, but not all the embodiments of the present disclosure. All the other embodiments obtained by those skilled in the art without paying any creative labor shall fall into the protection scope of the present disclosure.

Herein, it should be noted that in the figures, same reference numerals are given to components having the same or similar structures and functions basically, and repeated description relating thereto are omitted.

FIG. 1 is a schematic diagram of an array substrate and its gate driving signal according to an embodiment of the present disclosure. It can be seen from the right drawing of FIG. 1 that the array substrate comprises an array substrate, a data driving circuit and a gate driving circuit (i.e., GOA unit).

For example, the array substrate comprises M rows and N columns, the GOA unit has M gate lines, pixels located in a same row in the pixel array are connected to a same gate line, the data driving circuit has N data lines, and pixels in a same column in the pixel array are connected to a same data line. It shall be understood that connection manners of the pixel array, the data driving circuit and the GOA unit in the array substrate are not limited thereto, and the present disclosure is not limited to the connection manners of the pixel array, the data driving circuit and the GOA unit.

As seen from the left of FIG. 1, a gate driving signal output by a gate line of the GOA unit is usually a square wave pulse signal, which has a high voltage VGH and a low voltage VGL. For an N type TFT, the high voltage VGH is a turn-on voltage, and the low voltage VGL is a turn-off voltage; for a P type TFT, the high voltage VGH is a turn-off voltage, and the low voltage VGL is a turn-on voltage. Description is given by taking the N type TFT as an example.

In the case of a TFT connected to a gate line in the pixel array is an N type TFT, when the gate driving signal is at the low voltage VGL, the TFT is in a turn-off state and would not deliver data signals on the data line to pixels, so that one row of pixels connected to the gate line would not display according to data signals output currently from the data lines; when the gate driving signal is at the high voltage VGH, the TFT is in a turn-on state, the data signals on the data lines can be delivered to the pixels, so that pixels of one row connected to the gate line would display according to the data signals output currently from the data lines.

However, due to influence of electrical static discharge ESD or electrical over stress EOS, it is possible to cause that distortion occurs to waveform of the gate driving signal. Such distortion is possible to not only cause display abnormality of images on a liquid crystal panel or even cause damage of TFT in the pixel circuit on the liquid crystal panel.

In order to avoid the phenomenon of display abnormality or damage of the pixel circuit caused by occurrence of distortion to the waveform of the gate driving signal due to influence of ESD or EOS, a concept of performing the high voltage protection and the low voltage protection of the gate driving signal output by the GOA unit respectively is put forward according to the embodiments of the present disclosure.

Figure 2:
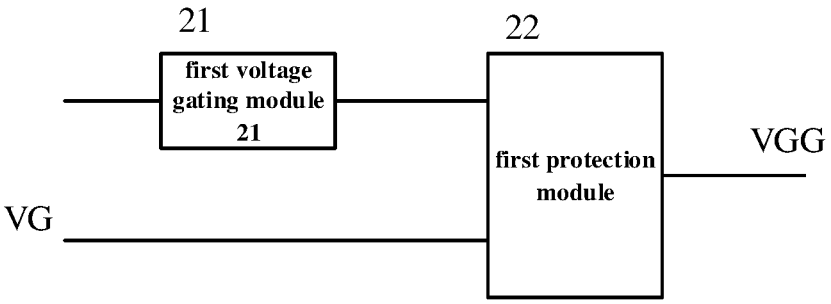
FIG. 2 is a schematic block diagram of a protection circuit connected to a gate line signal output terminal of a gate driver on array GOA unit according to an embodiment of the present disclosure.

FIG. 2 is a schematic block diagram of a protection circuit connected to a gate line signal output terminal of a gate driver on array GOA unit according to an embodiment of the present disclosure.

As shown in FIG. 2, the protection circuit comprises a first voltage gating module 21 and a first protection module 22.

An input terminal of the first voltage gating module 21 is connected to an output terminal of a first voltage source, and an output terminal thereof is connected to an input terminal of the first protection module 22. The output terminal of the first voltage gating module 21 outputs an output voltage of the output terminal of the first voltage source when the gate line signal output terminal should output a valid driving voltage of a gate driving signal.

Another input terminal of the first protection module 22 is connected to the gate line signal output terminal VG, and an output terminal VGG of the first protection module 22 is connected to a gate line.

The first protection module outputs the output voltage of the output terminal of the first voltage source as the gate driving signal in the case that the output voltage of the output terminal of the first voltage source and a current output voltage of the gate line signal output terminal satisfies a first predetermined condition.

According to a specific circuit design, the valid driving voltage of the gate driving signal may be a high voltage or a low voltage. The influence of the ESD or EOS on the output voltage of the gate line signal output terminal can be reflected as a voltage impact, which would be a positive impact or a negative impact. Description is given below by taking the valid driving voltage of the gate driving signal being the high voltage and an inactive driving voltage of the gate driving signal being the low voltage as an example. The valid driving voltage is capable of making a transistor connected to the gate line turned on, and the inactive driving voltage is incapable of making the transistor connected to the gate line turned on.

Due to influence of ESD or EOS, impact is possible to occur to the valid driving voltage of the gate driving signal. In the case that amplitude of such impact is very high, the TFT in the pixel circuit that receives the gate driving signal is possible to be broken down directly, and thus such impact needs to be suppressed.

According to the embodiment of the present disclosure, the output terminal of the first voltage source comprises a first output terminal, whose output voltage is a first power supply high voltage VDD1. The input terminal of the first voltage gating module comprises a first input terminal, and the output terminal thereof comprises a first output terminal. The input terminal of the first protection module comprises a first input terminal and a third input terminal, the first input terminal of the first protection module is connected to the first output terminal of the first voltage gating module, and the third input terminal of the first protection module is connected to the gate line signal output terminal.

Specifically, when the gate line signal output terminal should output the high voltage VGH of the gate driving signal, the first output terminal of the first voltage gating module 21 outputs the first power supply high voltage VDD1. In the case of normal operation, VDD1>VGH, and in the case that the current output voltage VG of the gate line signal output terminal is higher than the first power supply high voltage VDD1, the first protection module 22 pulls down the current output voltage VG of the gate line signal output terminal to the first power supply high voltage VDD1, and the output terminal of the first protection module 22 outputs the first power supply high voltage VDD1 as an adjusted gate driving signal VGG It shall be understood that due to the influence of ESD or EOS, not only positive impact but also negative impact is possible to occur to a valid level (high level) of the gate driving signal. Therefore, it needs to suppress not only positive impact but also negative impact.

Figure 3:
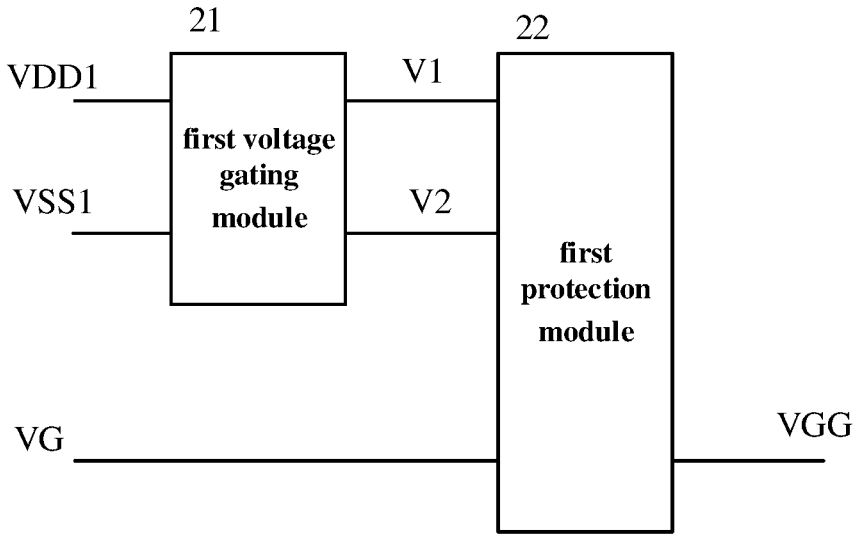
FIG. 3 is another schematic block diagram of a protection circuit connected to a gate line signal output terminal of a gate driver on array GOA unit according to an embodiment of the present disclosure.

FIG. 3 is another schematic block diagram of a protection circuit connected to a gate line signal output terminal of a gate driver on array GOA unit according to an embodiment of the present disclosure.

As shown in FIG. 3, the output terminal of the first voltage source further comprises a second output terminal, whose output voltage is a first power supply low voltage VSS1. The first voltage gating module 21 further comprises a second input terminal, which is connected to the second output terminal of the first voltage source. The input terminal of the first protection module 22 further comprises a second input terminal, which is connected to the second output terminal of the first voltage gating module 21.

Specifically, when the gate line signal output terminal should output the low voltage of the gate driving signal, the second output terminal of the first voltage gating module 21 outputs the first power supply low voltage VSS1, and in the case that the current output voltage of the gate line signal output terminal is lower than the first power supply low voltage VSS1, the first protection module 22 pulls up the current output voltage of the gate line signal output terminal to the first power supply low voltage VSS1, and the output terminal of the first protection module 22 outputs the first power supply low voltage VSS1 as an adjusted gate driving signal.

The first power supply high voltage VDD1, the normal high voltage VGH of the gate driving signal, and the first power supply low voltage VSS1 should satisfy the following relationship: VDD1>VGH>VSS1.

Figure 4:
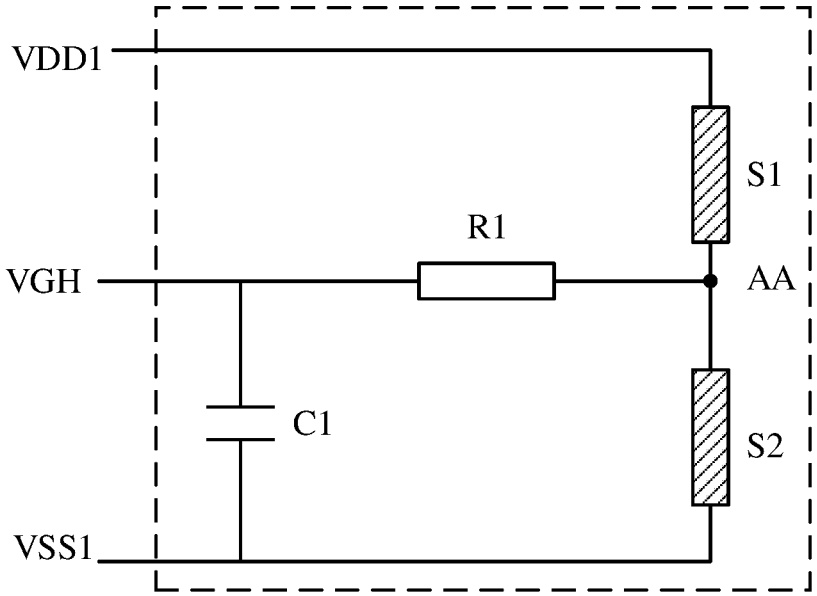
FIG. 4 is a principle diagram of a of a first protection module for performing a high voltage protection of a gate driving signal output by a GOA unit according to an embodiment of the present disclosure.

FIG. 4 a principle diagram of the first protection module 22 for performing a high voltage protection of a gate driving signal output by a GOA unit according to an embodiment of the present disclosure. The first protection module 22 is used to control or adjust the high voltage VGH of the gate driving signal VG.

As shown in FIG. 4, the first protection module 22 can comprise a first resistor R1 and a first protection element S1. The first resistor R1 is connected between the gate line signal output terminal and an output terminal AA of the first protection module 22, and the first protection element S1 is connected between the output terminal of the first protection module 22 and a first output terminal V1 (i.e., VDD1) of the first voltage gating module 21.

The first protection element S1 can absorbs ESD or EOS energy or releases the ESD or EOS energy to other loops when ESD or EOS occurs. For example, the first protection element S1 may be a diode which is switched on or off rapidly, a voltage-sensitive resistor, or a high molecular polymer, or may be an ESD/EOS protection circuit composed of a variety of semiconductor elements or other elements.

When the high voltage VGH of the gate driving signal VG exceeds the high voltage VDD1 of the first voltage source due to the influence of ESD or EOS, the first protection element S1 is turned on to absorb ESD or EOS energy or release the ESD or EOS energy to the first voltage source; in particular, the ESD or EOS energy is released to the first output terminal of the first voltage source via the first voltage gating module 21, so that the output terminal of the first protection module 22 is made to output the high voltage VDD1 of the first output terminal of the first voltage source as the adjusted gate driving signal VGG, that is, making the high voltage VGH of the adjusted gate driving signal VGG as the high voltage VDD1 of the first output terminal of the first voltage source.

In addition, as shown in FIG. 4, the first protection module 22 can further comprise a second protection element S2. The second protection element S2 is connected between the output terminal of the first protection module 22 and the second output terminal V2 (i.e., VSS1) of the first voltage gating module 21. The second protection element S2 can absorb the ESD or EOS energy or releases the ESD or EOS energy to other loops when the ESD or EOS occurs. For example, the second protection element S2 may be a diode which is switched on or off rapidly, a voltage-sensitive resistor, or a high molecular polymer, or may be an ESD/EOS protection circuit composed of a variety of semiconductor elements or other elements.

When the high voltage VGH of the gate driving signal VG is lower than the low voltage VSS1 of the second output terminal of the first voltage source due to the influence of ESD or EOS, the second protection element S2 is turned on to absorb ESD or EOS energy or release the ESD or EOS energy to the first voltage source; in particular, the ESD or EOS energy is released to the second output terminal of the first voltage source via the first voltage gating module 21, so that the output terminal of the first protection module 22 is made to output the low voltage VSS1 of the second output terminal of the first voltage source as the adjusted gate driving signal VGG, that is, making the high voltage VGH of the adjusted gate driving signal VGG as the low voltage VSS1 of the first output terminal of the first voltage source. For example, the first power supply low voltage VSS1 can be for example a common ground voltage VGND.

In addition, according to the requirement, the first protection module 22 can further comprise a first capacitor C1, which is connected between the gate line signal output terminal and the second output terminal of the first voltage gating module 21.

Figure 5:
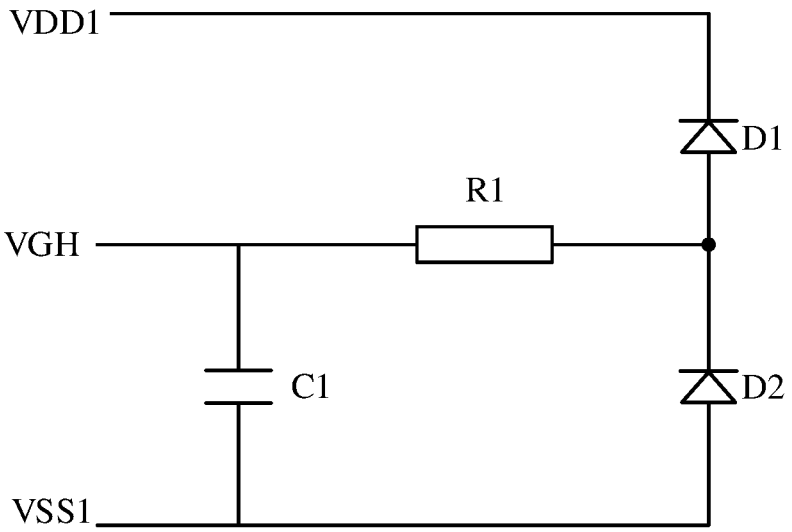
FIG. 5 is a schematic circuit diagram of the first protection module as shown in FIG. 4 according to an embodiment of the present disclosure.

FIG. 5 is a schematic circuit diagram of the first protection module 22 as shown in FIG. 4 according to an embodiment of the present disclosure.

As shown in FIG. 5, the first protection element S1 is a first diode D1, and the second protection element S2 is a second diode D2.

An anode and a cathode of the first diode D1 are connected to the output terminal of the first protection module 22 and the first output terminal V1 (i.e., VDD1) of the first voltage gating module 21 respectively, and an anode and a cathode of the second diode D2 are connected to the second output terminal V2 (i.e., VSS1) of the first voltage gating module 21 and the output terminal of the first protection module 22 respectively.

On one hand, when the high voltage VGH of the gate driving signal VG exceeds the high voltage VDD1 of the first voltage source due to the influence of ESD or EOS, the first diode D1 is turned on, and the ESD or EOS energy is released to the first output terminal of the first voltage source via the first voltage gating module 21, so that the output terminal of the first protection module 22 is made to output the high voltage VDD1 of the first output terminal of the first voltage source as the adjusted gate driving signal VGG, that is, making the high voltage VGH of the adjusted gate driving signal VGG as the first power supply high voltage VDD1.

On the other hand, when the high voltage VGH of the gate driving signal VG is lower than the low voltage VSS1 of the first voltage source due to the influence of ESD or EOS, the second diode D2 is turned on, and the ESD or EOS energy is released to the second output terminal of the first voltage source via the first voltage gating module 21, so that the output terminal of the first protection module 22 is made to output the low voltage VSS1 of the second output terminal of the first voltage source as the adjusted gate driving signal VGG, that is, making the high voltage VGH of the adjusted gate driving signal VGG as the first power supply low voltage VSS1.

Thus, the high voltage VGH of the gate driving signal VG can be clamped within a certain voltage range, in particular, within a range from VSS1 to VDD1 by means of the first voltage gating module 21 and the first protection module 22, so that damage caused by ESD or EOS on the TFT in the pixel circuit can be avoided. Further, by selecting amplitudes of VSS and VDD1 appropriately, for example, VDD1 is slightly higher than a normal VGH and VSS is slightly lower than the normal VGH, in particular, for example, VDD is 0.5V higher than the normal VGH and VSS is 0.5V lower than the normal VGH, it can be made that the high voltage VGH of the adjusted gate driving signal VGG is within a predetermined high voltage range, so that the pixel circuit is capable of reading the data signals on the data lines normally, so as to be capable of displaying normally, which avoids the display abnormality caused by distortion of the gate driving signal VG due to ESD or EOS.

Figure 6:
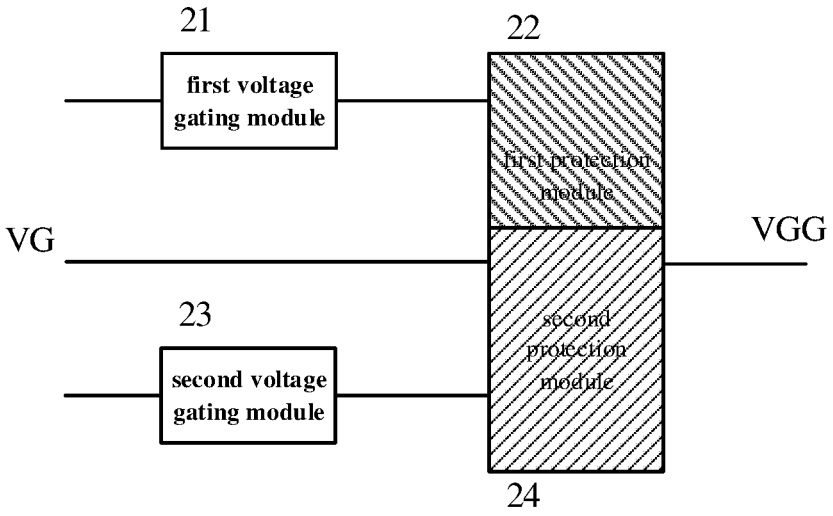
FIG. 6 is another schematic block diagram of a protection circuit connected to a gate line signal output terminal of a gate driver on array GOA unit according to an embodiment of the present disclosure.

FIG. 6 is another schematic block diagram of a protection circuit connected to a gate line signal output terminal of a gate driver on array GOA unit according to an embodiment of the present disclosure.

As shown in FIG. 6, except for the first voltage gating module 21 and the first protection module 22, the protection circuit further comprises a second voltage gating module 23 and a second protection module 24.

As described above, the input terminal of the first voltage gating module 21 is connected to the output terminal of the first voltage source, and the output terminal thereof is connected to the input terminal of the first protection module 22. When the gate line signal output terminal should output the valid driving voltage (for example, high voltage) of the gate driving signal, the output terminal of the first voltage gating module 21 outputs the output voltage of the output terminal of the first voltage source. Another input terminal of the first protection module 22 is connected to the gate line signal output terminal, and the output terminal of the first protection module 22 is connected to a gate line.

An input terminal of the second voltage gating module 23 is connected to an output terminal of a second voltage source, and an output terminal thereof is connected to an input terminal of the second protection module 24. When the gate line signal output terminal should output the inactive driving voltage (for example, low voltage) of the gate driving signal, the output terminal of the second voltage gating module 23 outputs an output voltage of the output terminal of the second voltage source. Another input terminal of the second protection module 24 is connected to the gate line signal output terminal.

The first protection module 22 and the second protection module 24 share a part of circuit. Another input terminal of the first protection module 22 and another input terminal of the second protection module 24 are the same input terminal, which is connected to the gate line signal output terminal. One terminal of the shared circuit is the same input terminal, and the other terminal thereof is connected to the gate line.

Specifically, the second protection module 24 outputs the output voltage of the output terminal of the second voltage source as the adjusted gate driving signal in the case that the output voltage of the output terminal of the second voltage source and the current output voltage of the gate line signal output terminal satisfy a second predetermined condition.

Due to the influence of ESD or EOS, impact is possible to occur to the inactive driving voltage (low voltage) of the gate driving signal. In the case that the amplitude of such impact is very high, the TFT in the pixel circuit that receives the gate driving signal is possible to be broken down directly, and thus such impact needs to be suppressed.

According to the embodiment of the present disclosure, the output terminal of the second voltage source comprises a first output terminal, whose output voltage is a second power supply high voltage. The input terminal of the second voltage gating module comprises a first input terminal, and the output terminal thereof comprises a first output terminal. The input terminal of the second protection module comprises a first input terminal and a third input terminal, the first input terminal of the second protection module is connected to the first output terminal of the second voltage gating module, and the third input terminal of the second protection module is connected to the gate line signal output terminal. Herein, the third input terminal of the first protection module and the third input terminal of the second protection module are a same shared input terminal.

Specifically, when the gate line signal output terminal should output the low voltage VGL of the gate driving signal, the first output terminal of the second voltage gating module 23 outputs the second power supply high voltage VDD2. In the case of normal operation, VDD2>VGL, and in the case that the current output voltage VG of the gate line signal output terminal is higher than the second power supply high voltage VDD2, the second protection module 24 pulls down the current output voltage VG of the gate line signal output terminal to the second power supply high voltage VDD2, and the output terminal of the second protection module 24 outputs the second power supply high voltage VDD2 as an adjusted gate driving signal VGG.

It shall be understood that due to the influence of ESD or EOS, not only positive impact but also negative impact is possible to occur to the inactive driving voltage (low voltage) of the gate driving signal. Therefore, it needs to suppress not only positive impact but also negative impact.

Figure 7:
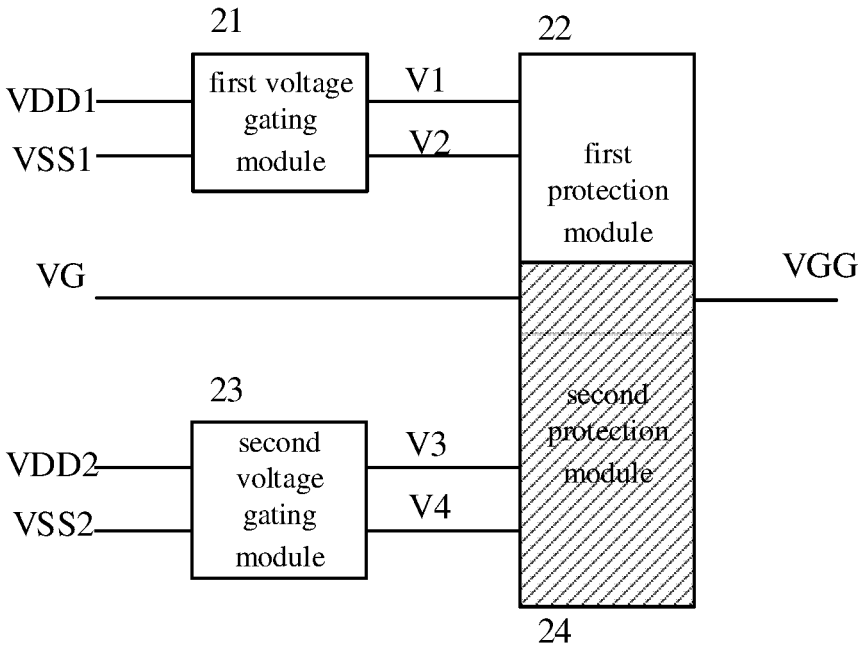
FIG. 7 is yet another schematic block diagram of a protection circuit connected to a gate line signal output terminal of a gate driver on array GOA unit according to an embodiment of the present disclosure.

FIG. 7 is another schematic block diagram of a protection circuit connected to a gate line signal output terminal of a gate driver on array GOA unit according to an embodiment of the present disclosure.

As shown in FIG. 7, the output terminal of the second voltage source further comprises a second output terminal, and an output voltage of the second output terminal is a second power supply low voltage VSS2.

The input terminal of the second voltage gating module 23 further comprises a second input terminal, which is connected to the second output terminal of the second voltage source. Except for the first output terminal V3, the output terminal of the second voltage gating module 23 further comprises a second output terminal V4, the input terminal of the second protection module 24 further comprises a second input terminal, which is connected to the second output terminal V4 of the second voltage gating module 23.

In particular, when the gate line signal output terminal should output the low level of the gate driving signal, the second output terminal V4 of the second voltage gating module 23 outputs the second power supply low voltage VSS2, and in the case that the current output voltage of the gate line signal output terminal is lower than the second power supply low voltage VSS2, the second protection module 24 pulls up the current output voltage of the gate line signal output terminal to the second power supply low voltage VSS2, and the output terminal of the second protection module 24 outputs the second power supply low voltage VSS2 as the adjusted gate driving signal.

The second power supply high voltage VDD2, the low voltage VGL of the gate driving signal, and the second power supply low voltage VSS2 shall satisfy the following relationship: VDD2>VGL>VSS2.

According to the requirement, the first power supply low voltage VSS1 can be higher than the second power supply high voltage VDD2, or the first power supply low voltage VSS1 can be the same as the second power supply high voltage VDD2. Therefore, the first power supply high voltage VDD1, the high voltage VGH of the gate driving signal, the first power supply low voltage VSS1, the second power supply high voltage VDD2, the low voltage VGL of the gate driving signal, and the second power supply low voltage VSS2 shall satisfy the following relationship: VDD1>VGH>VSS1≥VDD2>VGL>VSS2.

In the case of VGL being smaller than zero, optionally, VSS1 and VDD2 can be a common ground voltage GND.

Figure 8:
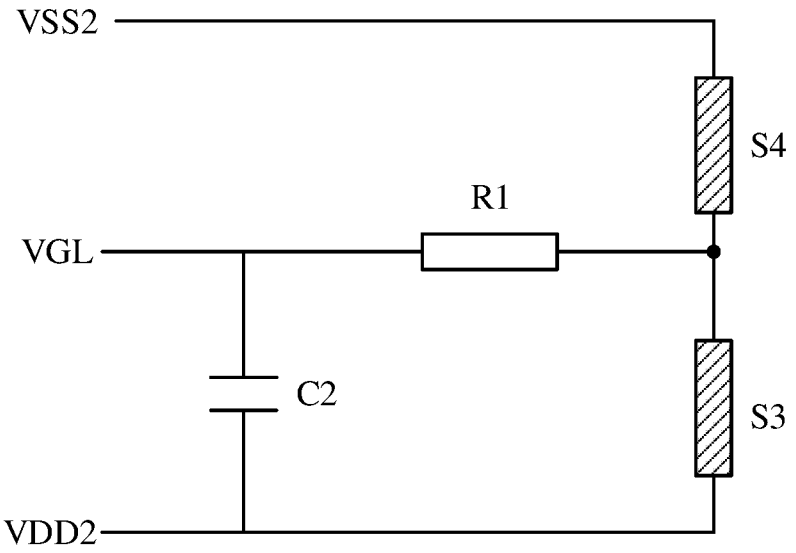
FIG. 8 is a principle diagram of a second protection module for performing a low voltage protection of a gate driving signal output by a GOA unit according to an embodiment of the present disclosure.

FIG. 8 is a principle diagram of a second protection module 24 for performing a low voltage protection of a gate driving signal output by a GOA unit according to an embodiment of the present disclosure.

As shown in FIG. 8, the second protection module 24 can comprise a first resistor R1 and a third protection element S3. The first protection module 22 and the second protection module 24 share the first resistor R1.

The first resistor R1 is connected between the gate line signal output terminal and the output terminal of the second protection module 24, and output terminals of the first protection module 22 and the second protection module 24 are a same output terminal. The third protection element S3 is connected between the output terminal of the second protection module 24 and the first output terminal of the second voltage gating module 23.

When the low voltage VGL of the gate driving signal VG exceeds the high voltage VDD2 of the second voltage source due to the influence of ESD or EOS, the third protection element S3 is turned on to absorb ESD or EOS energy or release the ESS or EOS energy to the second voltage source, in particular, the ESD or EOS energy is released to the first output terminal of the second voltage source via the second voltage gating module 23, so that the output terminal of the second protection module 24 is made to output the high voltage VDD2 of the first output terminal of the second voltage source as the adjusted gate driving signal VGG, that is, making the low voltage VGL of the adjusted gate driving signal VGG as the second power supply high voltage VDD2.

Additionally, as shown in FIG. 8, the second protection module 24 can further comprise a second capacitor C2, which is connected between the gate line signal output terminal and the first output terminal of the second voltage gating module 22.

Additionally, as shown in FIG. 8, the second protection module 24 can further comprise a fourth protection element S4, which is connected between the output terminal of the second protection module 24 and the second output terminal of the second voltage gating module 23.

When the low voltage VGL of the gate driving signal VG is lower than the low voltage VSS2 of the second voltage source due to the influence of ESD or EOS, the fourth protection element S4 is turned on to absorb ESD or EOS energy or release the ESD or EOS energy to the first voltages source, in particular, the ESD or EOS energy is released to the second output terminal of the first voltage source via the second voltage gating module 23, so that the output terminal of the second protection module 24 outputs the low voltage VSS2 of the second output terminal of the second voltage source as the adjusted gate diving signal VGG, that is, making the low voltage VGL of the adjusted gate driving signal VGG as the second power supply low voltage VSS2.

The third protection element S3 and the fourth protection element S4 can absorb ESD or EOS energy when ESD or EOS occurs or release the ESD or EOS energy to other loops. For example, the third protection element S3 and the fourth protection element S4 may be a diode which is switched on or off rapidly, a voltage-sensitive resistor, or a high molecular polymer, or may be an ESD/EOS protection circuit composed of a variety of semiconductor elements or other elements.

Figure 9:
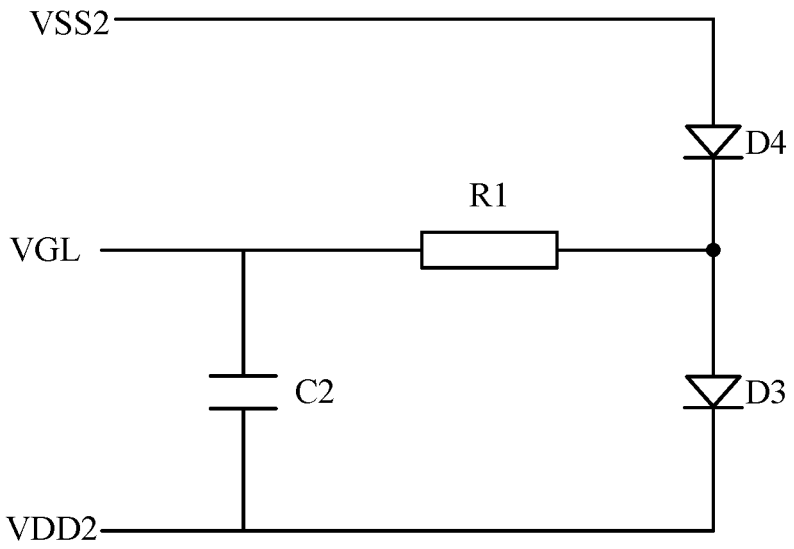
FIG. 9 is a schematic circuit diagram of the second protection module as shown in FIG. 8 according to an embodiment of the present disclosure.

FIG. 9 is a schematic circuit diagram of the second protection module 24 as shown in FIG. 8 according to an embodiment of the present disclosure.

As shown in FIG. 9, the third protection element S3 is a third diode D3, and the fourth protection element S4 is a fourth diode D4.

An anode and a cathode of the third diode D3 are connected to the output terminal of the second protection module 24 and the first output terminal of the second voltage gating module 23 respectively, and an anode and a cathode of the fourth diode D4 are connected to the second output terminal of the second voltage gating module 23 and the output terminal of the second protection module 24 respectively.

On one hand, when the low voltage VGL of the gate driving signal VG exceeds the high voltage VDD2 of the second voltage source due to the influence of ESD or EOS, the third diode D3 is turned on, and the ESD or EOS energy is releases to the first output terminal of the second voltage source via the second voltage gating module 23, so that the output terminal of the second protection module 24 is made to output the high voltage VDD2 of the first output terminal of the second voltage source as the adjusted gate driving signal VGG, that is, making the high voltage VGH of the adjusted gate driving signal VGG as the second power supply high voltage VDD2.

On the other hand, when the low voltage VGL of the gate driving signal VG is lower than the low voltage VSS2 of the second voltage source due to influence of ESD or EOS, the fourth diode D4 is turned on, and the ESD or EOS energy is released to the second output terminal of the second voltage source via the second voltage gating module 23, so that the output terminal of the second protection module 24 is made to output the low voltage VSS2 of the second output terminal of the second voltage source as the adjusted gate driving signal VGG, that is, making the low voltage VGL of the adjusted gate driving signal VGG as the second power supply low voltage VSS2.

Thus, the low voltage VGL of the gate driving signal VG can be clamped within a certain voltage range, in particular, within a range from VSS2 to VDD2, by the second voltage gating module 23 and the second protection module 24, so that damage caused by ESD or EOS on the TFT in the pixel circuit can be avoided. Further, by selecting the amplitudes of VSS2 and VDD2 appropriately, for example, VDD2 is slightly higher than VGL and VSS2 is slightly lower than VGL, in particular, for example, VDD2 is 0.5V higher than the VGL and VSS2 is 0.5V lower than the VGL, it can be made that the low voltage VGL of the adjusted gate driving signal VGG is within a predetermined high voltage range, so that the pixel circuit is capable of reading the data signals on the data lines normally, so as to be capable of displaying normally, which avoids the display abnormality caused by distortion of the gate driving signal VG due to influence of ESD or EOS.

Figure 10:
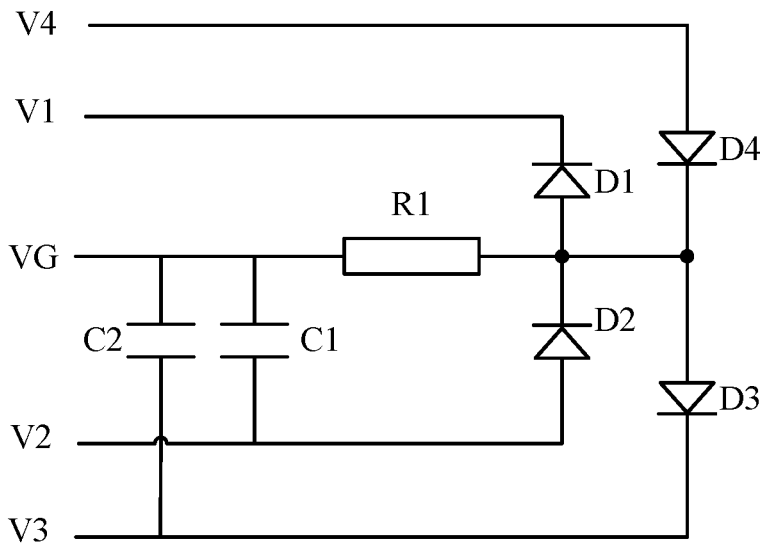
FIG. 10 is a combined circuit diagram of a first protection module and a second protection module for performing a high voltage protection and a low voltage protection of a gate driving signal output by a GOA unit according an embodiment of the present disclosure.

FIG. 10 is a combined circuit diagram of the first protection module 22 and the second protection module 24 for protecting a high voltage and a low voltage of a gate driving signal output by a GOA unit according an embodiment of the present disclosure.

When the gate line signal output terminal should output the high voltage VGH of the gate driving signal, the first voltage gating module 21 applies the first power supply high voltage VDD1 of the first voltage source to the input terminal V1 as shown in FIG. 10 and applies the first power supply low voltage VSS1 of the first voltage source to the input terminal V2 as shown in FIG. 10, while the second voltage gating module 23 does not apply the second power supply high voltage VDD2 of the second voltage source to the input terminal V3 as shown in FIG. 10 and does not apply the second power supply low voltage VSS2 of the second voltage source to the input terminal V4 as shown in FIG. 10. In this circumstance, when the current output voltage VG of the gate line signal output terminal exceeds the first power supply high voltage VDD1, the first diode D1 is turned on; when the current output voltage VG of the gate line signal output terminal is lower than the first power supply low voltage VSS1, the second diode D2 is turned on; however, since the input terminals VDD2 and VSS2 as shown in FIG. 10 are not input voltages, i.e., being floated, the third diode D3 and the fourth diode D4 would not be turned on even if the current output voltage VG of the gate line signal output terminal is higher than the second power supply high voltage VDD2 (in a circumstance of normal operation, the high voltage output by the gate line signal output terminal is higher than the second power supply high voltage VDD2).

*When the gate line signal output terminal should output the low voltage VGL of the gate driving signal terminal, the second voltage gating module 23 applies the second power supply high voltage VDD2 of the second voltage source to the input terminal V3 as shown in FIG. 10 and apply the second power supply low voltage VSS2 of the second voltage source to the input terminal V4 as shown in FIG. 10, while the first voltage gating module 21 does not apply the first power supply high voltage VDD1 of the first voltage source to the input terminal V1 as shown in FIG. 10 and does not apply the first power supply low voltage VSS1 of the first voltage source to the input terminal V2 as shown in FIG. 10. In this circumstance, when the current output voltage VG of the gate line signal output terminal exceeds the second power supply high voltage VDD2, the third diode D3 is turned on; when the current output voltage VG of the gate line signal output terminal is lower than the second power supply low voltage VSS2, the fourth diode D4 is turned on; However, since the input terminals V1 and V2 as shown in FIG. 10 are not input voltages, i.e., being floated, the first diode D1 and the second diode D2 would not be turned on even if the current output voltage VG of the gate line signal output terminal is lower than the first power supply low voltage VSS1 (in a circumstance of normal operation, the low voltage output by the gate line signal output terminal is lower than the first power supply low voltage VSS1).

Figure 11:
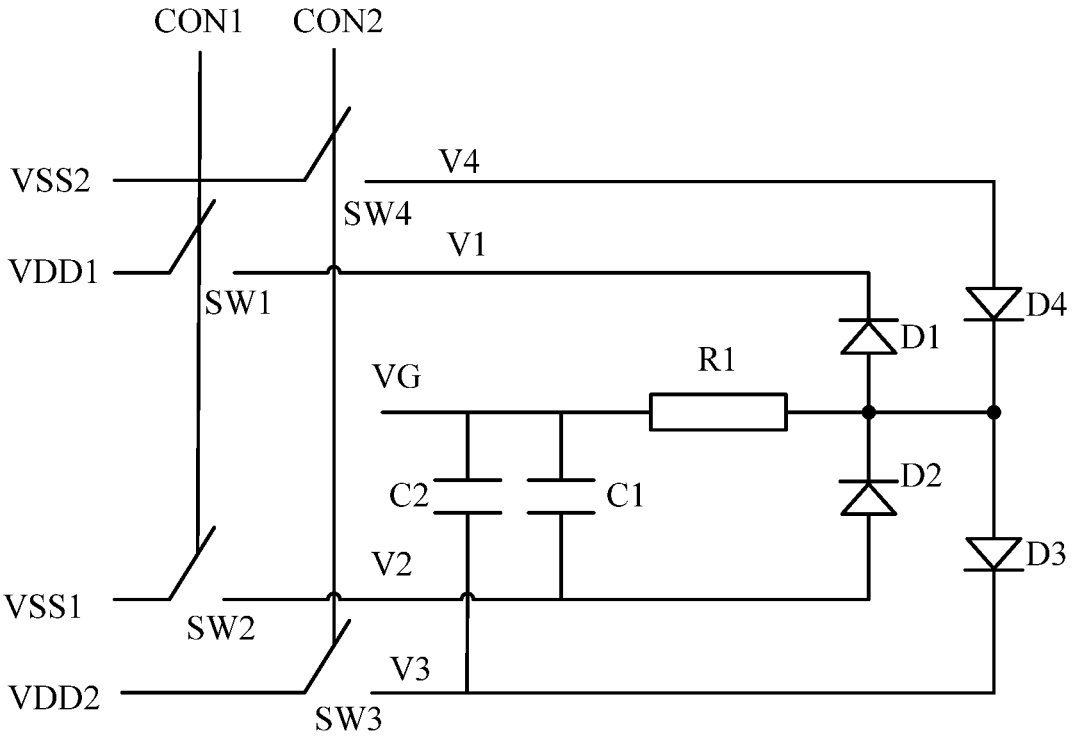
FIG. 11 is a specific circuit diagram of a protection circuit according to an embodiment of the present disclosure.

FIG. 11 is a specific circuit diagram of a protection circuit according to an embodiment of the present disclosure.

As shown in FIG. 11, the first voltage gating module 21 comprises a first switch SW1 and a second switch SW2. A first terminal of the first switch SW1 is connected to the first output terminal of the first voltage source, a second terminal thereof is the first output terminal V1 of the first voltage gating module, and a third terminal thereof is a control terminal; a first terminal of the second switch SW2 is connected to the second output terminal of the first voltage source, a second terminal thereof is the second output terminal V2 of the first voltage gating module 21, and a third terminal thereof is a control terminal. The third terminal of the first switch SW1 and the third terminal of the second switch SW2 are connected to a control terminal Con1.

As shown in FIG. 11, the second voltage gating module 23 comprises a third switch SW3 and a fourth switch SW4. A first terminal of the third switch SW3 is connected to the first output terminal of the second voltage source, a second terminal thereof is the first output terminal V3 of the second voltage gating module, and a third terminal thereof is a control terminal. A first terminal of the fourth switch SW4 is connected to the second output terminal of the second voltage source, a second terminal thereof is the second output terminal V4 of the second voltage gating module 23, and a third terminal thereof is a control terminal. The third terminal of the third switch SW3 and the third terminal of the fourth switch SW4 are connected to a control terminal Con2.

The first switch SW1, the second switch SW2, the third switch SW3, and the fourth switch SW4 can be implemented by TFT, and all of them may be N type TFTs or may be P type TFTs.

In the case of the first switch SW1, the second switch SW2, the third switch SW3, and the fourth switch SW4 being N type TFTs or P type TFTs, signals of the first control terminal Con1 and the second control terminal Con2 have opposite phases. When the first control terminal Con1 is at high level, the second control terminal Con2 is at low level; and when the first control terminal Con1 is at low level, the second control terminal Con1 is at high level.

In the case of the first switch SW1 and the second switch SW2 being N type TFTs and the third switch SW3 and the fourth switch SW4 being P type TFTs, or in the case of the first switch SW1 and the second switch SW2 being P type TFTs and the third switch SW3 and the fourth switch SW4 being N type TFTs, the first control terminal Con1 and the second control terminal Con2 can be a same control terminal.

Figure 12:
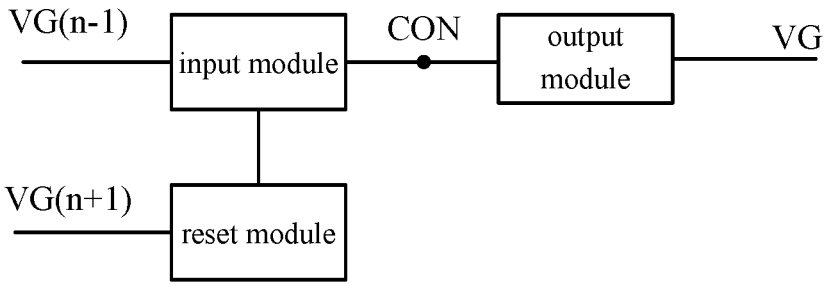
FIG. 12 is a schematic block diagram of a n-th stage of shift register of a GOA unit.

FIG. 12 is a schematic block diagram of n-th stage of shift register of a GOA unit.

As shown in FIG. 12, the shift register comprises an input module, an output module and a reset module, and a connecting point between the input module and the output module is an output control node CON of driving signal.

The input module receives a gate driving signal output by a previous stage (i.e., (n−1)-th stage) of shift register, and the reset module receives a gate driving signal output by a next stage (i.e., (n+1)-th stage) of shift register. When the output control node of driving signal is a valid level (for example, high level), an output module of the shift register outputs a valid level (for example, high level) of the gate driving signal.

As an example, in the case of the first switch SW1, the second switch SW2, the third switch SW3, and the fourth switch SW4 being the same type of TFTs, the first control terminal Con1 can be connected to the output control node CON of driving signal, the output control node CON of driving signal can be connected to an input terminal of an inverter, the inverter inverts the signal input from the output control node CON of driving signal and output it, and the second control terminal Con2 is connected to the output terminal of the inverter.

Figure 13:
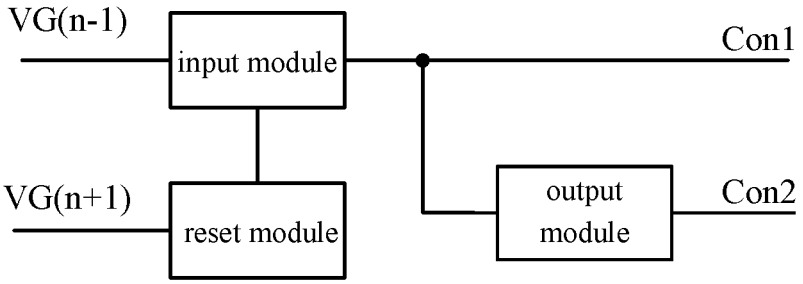
FIG. 13 is a schematic block diagram of a control module according to an embodiment of the present disclosure.

Alternatively, the protection circuit according to the embodiment of the present disclosure can further comprise a control module. FIG. 13 is a schematic block diagram of the control module according to an embodiment of the present disclosure.

The control module can comprise an input module, a reset module, and an inverter. The input module receives a gate driving signal output by a previous stage (i.e., (n−1)-th stage) of shift register, and the reset module receives a gate driving signal output by a next stage (i.e., (n+1)-th stage) of shift register. The input module and the reset module can be the same as the input module and the reset module as shown in FIG. 12, and thus no further description is given herein. It needs to ensure that a level of a first control terminal Con1 of a control circuit in FIG. 13 is the same as the level of the output control node CON of driving signal of the shift register in FIG. 12.

As an example, the output control node CON of driving signal is at a high level, the gate line signal output terminal outputs the high level of the gate driving signal, and the first control terminal Con1 is at the high level.

In particular, for example, the first switch SW1 and the second switch SW2 are N type TFTs, the third switch SW3 and the fourth switch SW4 are also N type TFTs, signals of the first control terminal Con1 and the second control terminal Con2 are opposite, the second control terminal Con2 is at a low level when the first control terminal Con1 is at the high level, the first switch SW1 and the second switch SW2 are turned on, and the third switch SW3 and the fourth switch SW4 are turned off.

In particular, for another example, the first switch SW1 and the second switch SW2 are N type TFTs, the third switch SW3 and the fourth switch SW4 are P type TFTs, and the first control terminal Con1 and the second control terminal Con2 are the same control terminal. In this circumstance, the inverter as shown in FIG. 13 can be omitted. The first switch SW1 and the second switch SW2 are turned on, the first power supply high voltage of the first voltage source is output by the second terminal of the first switch SW1, the first power supply low voltage of the first voltage source is output by the second terminal of the second switch SW2, and the third switch SW3 and the fourth switch SW4 are turned off.

The embodiment of the present disclosure is described by taking the high voltage of the gate driving signal being the valid driving voltage as an example. However, it shall be understood that the present disclosure is not limited thereto, and the valid driving voltage of the gate driving signal can be a low voltage.

According to the embodiment of the present disclosure, by performing the high voltage and the low voltage protection of the gate driving signal output by the GOA unit respectively, it can be made that the high level of the gate driving signal is within a predetermined high level range and that the low level of the gate driving signal is within a predetermined low level range, such that it not only can avoid from causing TFTs in the pixel circuit to be damaged due to voltage impact produced by EDS or EOS on the gate driving signal, but also can eliminate disadvantageous effect of display abnormality of the display panel caused by distortion of the gate driving signal due to EDS or EOS.

There is further provided in an embodiment of the present disclosure an array substrate, comprising a protection circuit of the gate driver on array GOA unit as described above.

Respective embodiments of the present disclosure are described in detail. However, those skilled in the art shall understand that various amendments, combinations or sub-combination can be made to these embodiments without departing from the principle and spirit of the present disclosure, and such amendments shall fall into the scope of the present disclosure.

The present application claims the priority of a Chinese patent application No. 201520692483.6 filed on Sep. 8, 2015, with disclosure title of "PROTECTION CIRCUIT FOR GATE DRIVER ON ARRAY UNIT, AND ARRAY SUBSTRATE". Herein, the content disclosed by the Chinese patent application is incorporated in full by reference.

What is claimed is:

1. A protection circuit of a gate driver on array GOA circuit, the protection circuit is connected between an output terminal of a first voltage source and a gate line signal output terminal of the GOA circuit, wherein the protection circuit comprises:

a first voltage gating module, whose input terminal is connected to an output terminal of a first voltage source, and configured to output an output voltage of the output terminal of the first voltage source at an output terminal thereof when the gate line signal output terminal outputs a valid driving voltage of a gate driving signal, be floated when the gate line signal output terminal outputs an inactive driving voltage of the gate driving signal, the valid driving voltage is a voltage capable of making a transistor connected to the gate line turned on, and the inactive driving voltage is a voltage incapable of making the transistor connected to the gate line turned on; and a first protection module, whose input terminal is connected to the output terminal of the first voltage gating module and the gate line signal output terminal respectively, and output terminal is connected to a gate line;

wherein in the case that a current output voltage of the gate line signal output terminal is higher than the output voltage of the output terminal of the first voltage source, the first protection module pulls down the current output voltage of the gate line signal output terminal to the output voltage of the output terminal of the first voltage source via the first voltage gating module, and in the case that a current output voltage of the gate line signal output terminal is lower than the output voltage of the output terminal of the first voltage source, the first protection module pulls up the current output voltage of the gate line signal output terminal to the output voltage of the output terminal of the first voltage source via the first voltage gating module, and the first protection module outputs the output voltage of the output terminal of the first voltage source as an adjusted gate driving signal, the output terminal of the first voltage source comprises a first output terminal, an input terminal of the first voltage gating module comprises a first input terminal connected to the first output terminal of the first voltage source, and an output terminal thereof comprises a first output terminal, and an input terminal of the first protection module comprises a first input terminal connected to the first output terminal of the first voltage gating module, the output terminal of the first voltage source further comprises a second output terminal, the input terminal of the first voltage gating module further comprises a second input terminal connected to a second output terminal of the first voltage source, and the output terminal thereof further comprises a second output terminal, and the input terminal of the first protection module further comprises a second input terminal connected to the second output terminal of the first voltage gating module, the gate line signal output terminal is an output terminal of a shift register in the GOA circuit, the shift register comprises an input module, an output module and a reset module, and a connecting point between the input module and the output module is a driving signal output control node, the first voltage gating module comprises a first switch and a second switch, wherein a first terminal of the first switch is connected to the first output terminal of the first voltage source, a second terminal thereof is the first output terminal of the first voltage gating module, and a third terminal thereof is a control terminal; a first terminal of the second switch is connected to the second output terminal of the first voltage source, a second terminal thereof is the second output terminal of the first voltage gating module, and a third terminal thereof is a control terminal, the third terminals of the first switch and the second switch are connected to the driving signal output control node, or the third terminals of the first switch and the second switch are connected to another node, and a level at the another node is the same as a level at the driving signal output control node, and when the gate line signal output terminal outputs a high level of the gate driving signal, the driving signal output control node is at a valid level, so that the first switch and the second switch are turned on, the first power supply high voltage of the first voltage source is output at the second terminal of the first switch, and the first power supply low voltage of the first voltage source is output at the second terminal of the second switch.

2. The protection circuit according to claim 1, wherein the valid driving voltage of the gate driving signal is a high voltage, the output voltage of the first output terminal is a first power supply high voltage, wherein when the gate line signal output terminal should output the high voltage of the gate driving signal, the first output terminal of the first voltage gating module outputs the first power supply high voltage, and in the case that a current output voltage of the gate line signal output terminal is higher than the first power supply high voltage, the first protection module pulls down the current output voltage of the gate line signal output terminal to the first power supply high voltage, and the output terminal of the first protection module outputs the first power supply high voltage as the adjusted gate driving signal.

3. The protection circuit according to claim 2, wherein, the output voltage of the second output terminal is a first power supply low voltage, wherein when the gate line signal output terminal should output the high voltage of the gate driving signal, the second output terminal of the first voltage gating module outputs the first power supply low voltage, and in the case that the current output voltage of the gate line signal output terminal is lower than the first power supply low voltage, the first protection module pulls up the current output voltage of the gate line signal output terminal to the first power supply low voltage, and the output terminal of the first protection module outputs the first power supply low voltage as the adjusted gate driving signal.

4. The protection circuit according to claim 3, wherein the first protection module comprises a first resistor, a first diode, and a second diode; and the first resistor is connected between the gate line signal output terminal and the output terminal of the first protection module, an anode and a cathode of the first diode are connected to the output terminal of the first protection module and the first output terminal of the first voltage gating module respectively, and an anode and a cathode of the second diode are connected to the second output terminal of the first voltage gating module and the output terminal of the first protection module respectively.

5. The protection circuit according to claim 3, wherein the first protection module comprises a first resistor, a first voltage-sensitive resistor or high molecular polymer device, a second voltage-sensitive resistor or high molecular polymer device; and the first resistor is connected between the gate line signal output terminal and the output terminal of the first protection module, the first voltage-sensitive resistor or high molecular polymer device is connected between the output terminal of the first protection module and the first output terminal of the first voltage gating module, and the second voltage-sensitive resistor or high molecular polymer device is connected between the second output terminal of the first voltage gating module and the output terminal of the first protection module.

6. The protection circuit according to claim 1, wherein the protection circuit further comprises:

a second voltage gating module, whose input terminal is connected to an output terminal of a second voltage source, and configured to output an output voltage of the output terminal of the second voltage source at an output terminal thereof when the gate line signal output terminal shall output an inactive driving voltage of the gate driving signal; and a second protection module, whose input terminal is connected to the output terminal of the second voltage gating module and output terminal is connected to the gate line;

wherein in the case that the output voltage of the output terminal of the second voltage source and the current output voltage of the gate line signal output terminal satisfy a second predetermined condition, the second protection module outputs the output voltage of the output terminal of the second voltage source as the adjusted gate driving signal.

7. The protection circuit according to claim 6, wherein the inactive driving voltage of the gate driving signal is a low voltage, the output terminal of the second voltage source comprises a first output terminal, whose output voltage is a second power supply high voltage, the input terminal of the second voltage gating module comprises a first input terminal connected to the first output terminal of the second voltage source, and the output terminal thereof comprises a first output terminal, and the input terminal of the second protection module comprises a first input terminal connected to the first output terminal of the second voltage gating module, wherein when the gate line signal output terminal should output the low voltage of the gate driving signal, the first output terminal of the second voltage gating module outputs the second power supply high voltage, and in the case that the current output voltage of the gate line signal output terminal is higher than the second power supply high voltage, the second protection module pulls down the current output voltage of the gate line signal output terminal to the second power supply high voltage and outputs the second power supply high voltage as the adjusted gate driving signal.

8. The protection circuit according to claim 7, wherein the output terminal of the second voltage source further comprises a second output terminal, whose output voltage is a second power supply low voltage, the input terminal of the second voltage gating module further comprises a second input terminal connected to the second output terminal of the second voltage source and the output terminal thereof comprise a first output terminal, and the input terminal of the second protection module comprises a second input terminal connected to a second output terminal of the second voltage gating module, wherein when the gate line signal output terminal should output the low voltage of the gate driving signal, the second output terminal of the second voltage gating module outputs the second power supply low voltage, and in the case that the current output voltage of the gate line signal output terminal is lower than the second power supply low voltage, the second protection module pulls up the current output voltage of the gate line signal output terminal to the second power supply low voltage and outputs the second power supply low voltage as the adjusted gate driving signal.

9. The protection circuit according to claim 8, wherein the gate line signal output terminal is the output terminal of the shift register in the GOA circuit, the shift register comprises an input module, an output module and a reset module, and a connecting point between the input module and the output module is a driving signal output control node, the second voltage gating module comprises a third switch and a fourth switch, a first terminal of the third switch is connected to the first output terminal of the second voltage source, a second terminal thereof is the first output terminal of the second voltage gating module, and a third terminal thereof is a control terminal; a first terminal of the fourth switch is connected to the second output terminal of the second voltage source, a second terminal thereof is the second output terminal of the second voltage gating module, and a third terminal thereof is a control terminal, the third terminals of the third switch and the fourth switch are connected to the driving signal output control node, or the third terminals of the third switch and the fourth switch are connected to another node, and a level at the another node is the same as a level at the driving signal output control node, and when the gate line signal output terminal outputs the low level of the gate driving signal, the driving signal output control node is at an inactive level, so that the third switch and the fourth switch are turned on, the second power supply high voltage of the second voltage source is output at the second terminal of the third switch, and the second power supply low voltage of the second voltage source is output at the second terminal of the fourth switch.

10. The protection circuit according to claim 8, wherein, the second protection module comprises a third diode and a fourth diode; and an anode and a cathode of the third diode are connected to the output terminal of the second protection module and the first output terminal of the second voltage gating module respectively, and an anode and a cathode of the fourth diode are connected to the second output terminal of the second voltage gating module and the output terminal of the second protection module.

11. The protection circuit according to claim 8, wherein the second protection module comprises a third voltage-sensitive resistor or high molecular polymer device, a fourth voltage-sensitive resistor or high molecular polymer device; and the third voltage-sensitive resistor or high molecular polymer device is connected between the output terminal of the second protection module and the first output terminal of the second voltage gating module, and the fourth voltage-sensitive resistor or high molecular polymer device is connected between the second output terminal of the second voltage gating module and the output terminal of the second protection module.

12. An array substrate, wherein, comprising the protection circuit of the gate driver on array GOA circuit according to claim 1.

13. The array substrate according to claim 12, wherein the valid driving voltage of the gate driving signal is a high voltage, the output terminal of the first voltage source comprises a first output terminal, whose output voltage is a first power supply high voltage, an input terminal of the first voltage gating module comprises a first input terminal connected to the first output terminal of the first voltage source, and an output terminal thereof comprises a first output terminal, and an input terminal of the first protection module comprises a first input terminal connected to the first output terminal of the first voltage gating module, wherein when the gate line signal output terminal should output the high voltage of the gate driving signal, the first output terminal of the first voltage gating module outputs the first power supply high voltage, and in the case that a current output voltage of the gate line signal output terminal is higher than the first power supply high voltage, the first protection module pulls down the current output voltage of the gate line signal output terminal to the first power supply high voltage, and the output terminal of the first protection module outputs the first power supply high voltage as the adjusted gate driving signal.

14. The array substrate according to claim 13, wherein, the output terminal of the first voltage source further comprises a second output terminal, whose output voltage is a first power supply low voltage, the input terminal of the first voltage gating module further comprises a second input terminal connected to a second output terminal of the first voltage source, and the output terminal thereof further comprises a second output terminal, and the input terminal of the first protection module further comprises a second input terminal connected to the second output terminal of the first voltage gating module, wherein when the gate line signal output terminal should output the high voltage of the gate driving signal, the second output terminal of the first voltage gating module outputs the first power supply low voltage, and in the case that the current output voltage of the gate line signal output terminal is lower than the first power supply low voltage, the first protection module pulls down the current output voltage of the gate line signal output terminal to the first power supply low voltage, and the output terminal of the first protection module outputs the first power supply low voltage as the adjusted gate driving signal.

15. The array substrate according to claim 12, wherein the protection circuit further comprises:

a second voltage gating module, whose input terminal is connected to an output terminal of a second voltage source, and configured to output an output voltage of the output terminal of the second voltage source at an output terminal thereof when the gate line signal output terminal shall output an inactive driving voltage of the gate driving signal; and a second protection module, whose input terminal is connected to the output terminal of the second voltage gating module and output terminal is connected to the gate line;

wherein in the case that the output voltage of the output terminal of the second voltage source and the current output voltage of the gate line signal output terminal satisfy a second predetermined condition, the second protection module outputs the output voltage of the output terminal of the second voltage source as the adjusted gate driving signal.

16. The array substrate according to claim 15, wherein the inactive driving voltage of the gate driving signal is a low voltage, the output terminal of the second voltage source comprises a first output terminal, whose output voltage is a second power supply high voltage, the input terminal of the second voltage gating module comprises a first input terminal connected to the first output terminal of the second voltage source, and the output terminal thereof comprises a first output terminal, and the input terminal of the second protection module comprises a first input terminal connected to the first output terminal of the second voltage gating module, wherein when the gate line signal output terminal should output the low voltage of the gate driving signal, the first output terminal of the second voltage gating module outputs the second power supply high voltage, and in the case that the current output voltage of the gate line signal output terminal is higher than the second power supply high voltage, the second protection module pulls down the current output voltage of the gate line signal output terminal to the second power supply high voltage and outputs the second power supply high voltage as the adjusted gate driving signal.

17. The array substrate according to claim 16, wherein the output terminal of the second voltage source further comprises a second output terminal, whose output voltage is a second power supply low voltage, the input terminal of the second voltage gating module further comprises a second input terminal connected to the second output terminal of the second voltage source and the output terminal thereof comprise a first output terminal, and the input terminal of the second protection module comprises a second input terminal connected to a second output terminal of the second voltage gating module, wherein when the gate line signal output terminal should output the low voltage of the gate driving signal, the second output terminal of the second voltage gating module outputs the second power supply low voltage, and in the case that the current output voltage of the gate line signal output terminal is lower than the second power supply low voltage, the second protection module pulls up the current output voltage of the gate line signal output terminal to the second power supply low voltage and outputs the second power supply low voltage as the adjusted gate driving signal.

18. The array substrate according to claim 14, wherein the gate line signal output terminal is an output terminal of a shift register in the GOA circuit, the shift register comprises an input module, an output module and a reset module, and a connecting point between the input module and the output module is a driving signal output control node, the first voltage gating module comprises a first switch and a second switch, wherein a first terminal of the first switch is connected to the first output terminal of the first voltage source, a second terminal thereof is the first output terminal of the first voltage gating module, and a third terminal thereof is a control terminal; a first terminal of the second switch is connected to the second output terminal of the first voltage source, a second terminal thereof is the second output terminal of the first voltage gating module, and a third terminal thereof is a control terminal, the third terminals of the first switch and the second switch are connected to the driving signal output control node, or the third terminals of the first switch and the second switch are connected to another node, and a level at the another node is the same as a level at the driving signal output control node, and when the gate line signal output terminal outputs a high level of the gate driving signal, the driving signal output control node is at a valid level, so that the first switch and the second switch are turned on, the first power supply high voltage of the first voltage source is output at the second terminal of the first switch, and the first power supply low voltage of the first voltage source is output at the second terminal of the second switch.

19. The array substrate according to claim 17, wherein the gate line signal output terminal is the output terminal of the shift register in the GOA circuit, the shift register comprises an input module, an output module and a reset module, and a connecting point between the input module and the output module is a driving signal output control node, the second voltage gating module comprises a third switch and a fourth switch, a first terminal of the third switch is connected to the first output terminal of the second voltage source, a second terminal thereof is the first output terminal of the second voltage gating module, and a third terminal thereof is a control terminal; a first terminal of the fourth switch is connected to the second output terminal of the second voltage source, a second terminal thereof is the second output terminal of the second voltage gating module, and a third terminal thereof is a control terminal, the third terminals of the third switch and the fourth switch are connected to the driving signal output control node, or the third terminals of the third switch and the fourth switch are connected to another node, and a level at the another node is the same as a level at the driving signal output control node, and when the gate line signal output terminal outputs the low level of the gate driving signal, the driving signal output control node is at an inactive level, so that the third switch and the fourth switch are turned on, the second power supply high voltage of the second voltage source is output at the second terminal of the third switch, and the second power supply low voltage of the second voltage source is output at the second terminal of the fourth switch.

20. A protection circuit of a gate driver on array GOA circuit, the protection circuit is connected between an output terminal of a first voltage source and a gate line signal output terminal of the GOA circuit, wherein the protection circuit comprises:

a first voltage gating module, whose input terminal is connected to an output terminal of a first voltage source, the output terminal of the first voltage source comprising a first output terminal whose output voltage is a first power supply high voltage (VDD1) and a second output terminal whose output voltage is a first power supply low voltage (VSS1);

a second voltage gating module, whose input terminal is connected to an output terminal of a second voltage source, the output terminal of the second voltage source comprising a first output terminal whose output voltage is a second power supply high voltage (VDD2) and a second output terminal whose output voltage is a second power supply low voltage (VSS2);

a first protection module, whose input terminal is connected to the output terminal of the first voltage gating module and the gate line signal output terminal respectively, and output terminal is connected to a gate line;

a second protection module, whose input terminal is connected to the output terminal of the second voltage gating module and the gate line signal output terminal respectively, and output terminal is connected to the gate line;

wherein the first protection module comprises a first resistor, a first diode, a second diode, and a first capacitor, the first resistor is connected between the gate line signal output terminal and the output terminal of the first protection module, an anode and a cathode of the first diode are connected to the output terminal of the first protection module and a first output terminal of the first voltage gating module respectively, an anode and a cathode of the second diode are connected to a second output terminal of the first voltage gating module and the output terminal of the first protection module respectively, and the first capacitor is connected between the gate line signal output terminal and the second output terminal of the first voltage gating module, the second protection module comprises a third diode, a fourth diode, and a second capacitor, an anode and a cathode of the third diode are connected to the output terminal of the second protection module and a first output terminal of the second voltage gating module respectively, an anode and a cathode of the fourth diode are connected to a second output terminal of the second voltage gating module and the output terminal of the second protection module, and the second capacitor is connected between the gate line signal output terminal and the first output terminal of the second voltage gating module, the output terminal of the first voltage source comprises a first output terminal, an input terminal of the first voltage gating module comprises a first input terminal connected to the first output terminal of the first voltage source, and an output terminal thereof comprises the first output terminal, and an input terminal of the first protection module comprises a first input terminal connected to the first output terminal of the first voltage gating module, the output terminal of the first voltage source further comprises the second output terminal, the input terminal of the first voltage gating module further comprises a second input terminal connected to a second output terminal of the first voltage source, and the output terminal thereof further comprises the second output terminal, and the input terminal of the first protection module further comprises a second input terminal connected to the second output terminal of the first voltage gating module, the gate line signal output terminal is an output terminal of a shift register in the GOA circuit, the shift register comprises an input module, an output module and a reset module, and a connecting point between the input module and the output module is a driving signal output control node, the first voltage gating module comprises a first switch and a second switch, wherein a first terminal of the first switch is connected to the first output terminal of the first voltage source, a second terminal thereof is the first output terminal of the first voltage gating module, and a third terminal thereof is a control terminal; a first terminal of the second switch is connected to the second output terminal of the first voltage source, a second terminal thereof is the second output terminal of the first voltage gating module, and a third terminal thereof is a control terminal, the third terminals of the first switch and the second switch are connected to the driving signal output control node, or the third terminals of the first switch and the second switch are connected to another node, and a level at the another node is the same as a level at the driving signal output control node, the output terminal of the second voltage source comprises a first output terminal, the input terminal of the second voltage gating module comprises a first input terminal connected to the first output terminal of the second voltage source, and the output terminal thereof comprises the first output terminal, and the input terminal of the second protection module comprises a first input terminal connected to the first output terminal of the second voltage gating module, the output terminal of the second voltage source further comprises a second output terminal, the input terminal of the second voltage gating module further comprises a second input terminal connected to the second output terminal of the second voltage source, and the output terminal thereof further comprises the second output terminal, and the input terminal of the second protection module further comprises a second input terminal connected to the second output terminal of the second voltage gating module, the second voltage gating module comprises a third switch and a fourth switch, a first terminal of the third switch is connected to the first output terminal of the second voltage source, a second terminal thereof is the first output terminal of the second voltage gating module, and a third terminal thereof is a control terminal; a first terminal of the fourth switch is connected to the second output terminal of the second voltage source, a second terminal thereof is the second output terminal of the second voltage gating module, and a third terminal thereof is a control terminal, the third terminals of the third switch and the fourth switch are connected to the driving signal output control node, or the third terminals of the third switch and the fourth switch are connected to another node, and a level at the another node is the same as a level at the driving signal output control node.

* * * * *